US006419221B1

(12) United States Patent
Spall

(10) Patent No.: US 6,419,221 B1
(45) Date of Patent: Jul. 16, 2002

(54) ADAPTIVE FLAG WEIGHT FOR DOCUMENT HANDLING APPARATUS

(75) Inventor: J. Michael Spall, Plymouth, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/521,162

(22) Filed: Mar. 8, 2000

(51) Int. Cl.[7] ..... B65H 1/02

(52) U.S. Cl. ..... 271/31.1; 271/129; 271/149; 271/160

(58) Field of Search ..... 27/31.1, 129, 147–149, 27/160; 221/226–232, 279

(56) References Cited

U.S. PATENT DOCUMENTS 3,035,834 A * 5/1962 Bottrell ..... 271/160
3,240,489 A * 3/1966 Pickney et al. ..... 371/160
3,598,399 A * 8/1971 Cottrell ..... 271/160
4,524,965 A * 6/1985 Kulpa ..... 271/160
4,953,748 A * 9/1990 Wheelock ..... 271/160
5,890,712 A * 4/1999 Phillips et al. ..... 271/160

* cited by examiner

*Primary Examiner*—Christopher P Ellis
*Assistant Examiner*—Mark A. Deuble
(74) *Attorney, Agent, or Firm*—Gordon K. Harris, Jr.; Lise A. Rode; Mark T. Starr

(57) ABSTRACT

An arrangement for adaptively driving the flag element of a document handling device, such as a document sorter. The invention uses a force generating mechanism to produce torque at the periphery of a cam. A flexible connector that is wrapped around the cam is used to pull the flag element. The cam is shaped such that the force exerted on the flag element produced by constant torque varies in accordance with the size of the document stack in the hopper of the document handling device.

17 Claims, 2 Drawing Sheets

ADAPTIVE FLAG WEIGHT FOR DOCUMENT HANDLING APPARATUS

CROSS REFERENCE TO RELATED APPLICATIONS

The subject matter of this application is related to the subject matter set forth in co-pending U.S. patent application No. 09/740,681, entitled "Adaptive Flag Weight For Document Handling Apparatus," filed Dec. 19, 2000, which is assigned to the assignee of the application hereof.

BACKGROUND OF THE INVENTION

1. Field of the Invention

This invention relates generally to document handling devices, and more particularly, to an arrangement for adaptively driving a flag element of a document handling device.

2. Discussion

Document handling devices are commonly used today to quickly move and sort a variety of documents. Documents are often stacked and automatically fed from the document stack. A feeding mechanism is used to introduce each document to its document transport for processing and sorting. It is important to introduce each document singly, with consistent spacing, to permit the fastest feed rate possible while still maintaining proper document processing.

In high speed sorters, a hopper is often used to supply documents to the feeding mechanism. A device, commonly known as a flag, is used to move documents across the hopper during feeding. To create this movement, the flag applies a force to the last document in the stack.

A number of systems are commonly known for applying the flag force. One such flag driving system is a non-controllable dead weight system. This system uses potential energy derived from a constant weight that is attached to the flag by a cord or some other flexible connector to create a tension on the cord, and therefore, a force on the flag. The net result is a force transmitting from the flag onto the document stack.

A drawback of this non-controllable dead weight system is that it is not able to maximize the performance of the document handling device. Specifically, it is deficient in maintaining proper document spacing. The source of this deficiency relates to the force exerted by the flag on the document stack. For example, pushing a stack of several thousand documents requires far more force than pushing the last few documents. In this system, however, the force exerted by the flag on the document stack does not vary according to the number of documents in the stack. This inability to adequately control the force exerted on the document stack results in inconsistent spacing, thereby causing the performance of the document handling device to suffer.

A variation of the dead weight system, herein referred to as the variable dead weight system, attempts to improve the non-controllable dead weight system to maximize the performance of the document handling device. The variable dead weight system attempts to adjust the flag force by using a variable dead weight, such as a chain that falls onto a supporting surface during flag travel, attached to the flag. As the document stack is reduced and the flag moves accordingly, the chain falls onto the supporting surface, thereby reducing the flag force. Although this system can better match the flag force to the force required to move the document stack, it is still not responsive to the actual force requirements that may vary due to conditions in the document stack.

Another method of producing flag force against a document stack is to use some sort of motor arrangement. To best adapt to flag force requirements, many motor driven flag systems often use sensors to measure and adjust the flag motion and force. However, because the mechanical environment created by a feed sorter can be violent, the sensors must undergo filtering to ensure that the sensed values are accurate. Although these systems are more responsive to flag force requirements, they are complex, costly and are subject to maintenance issues. It is desirable to provide an improved mechanism that produces a flag force that is responsive to the force needed to move the document stack.

SUMMARY OF THE INVENTION

It is therefore an object of the present invention to provide an apparatus for driving a flag element capable of presenting an adjustable force for moving a document stack.

A further object of the present invention is to provide an arrangement for adaptively driving the flag element of a document handling device that is durable, reliable, and economical to produce.

Accordingly, the present invention is directed to an arrangement for adaptively driving the flag element of a document handling device, such as a document sorter. The invention uses a force generating mechanism to produce a torque on the periphery of a cam. A flexible connector that wraps around the cam is used to pull the flag element. The cam is shaped such that the force exerted on the flag element produced by constant torque varies in accordance with the size of the document stack in the hopper of the document handling device.

BRIEF DESCRIPTION OF THE DRAWINGS

Additional objects, features, and advantages of the present invention will become apparent from studying the following detailed description and claims when taken in conjunction with the accompanying drawing, in which:

DETAILED DESCRIPTION

Figure 1:
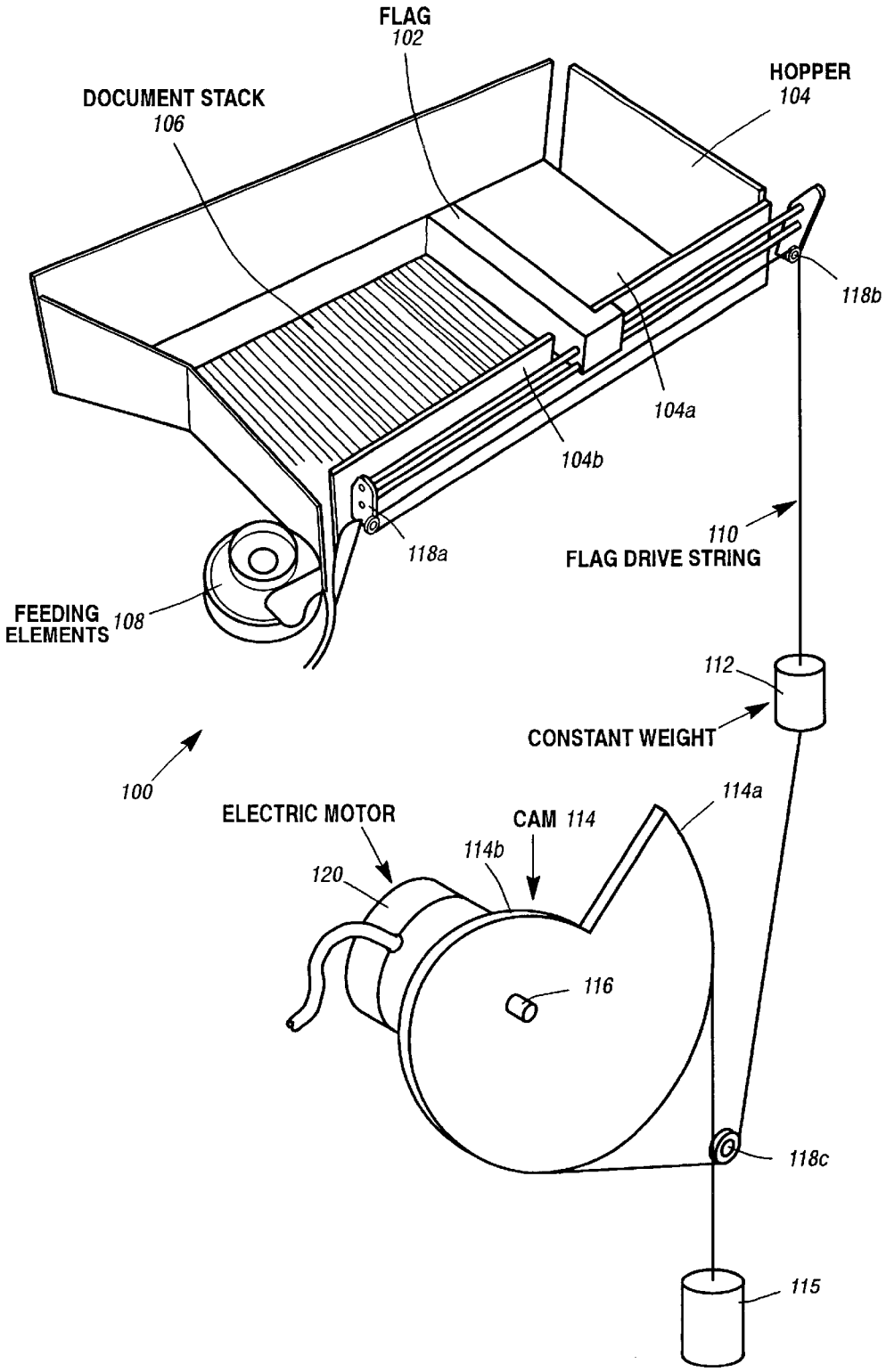
FIG. 1 is a perspective view of an arrangement for adaptively driving the flag element of a document handling device according to the principles of the present invention.
Figure 2:
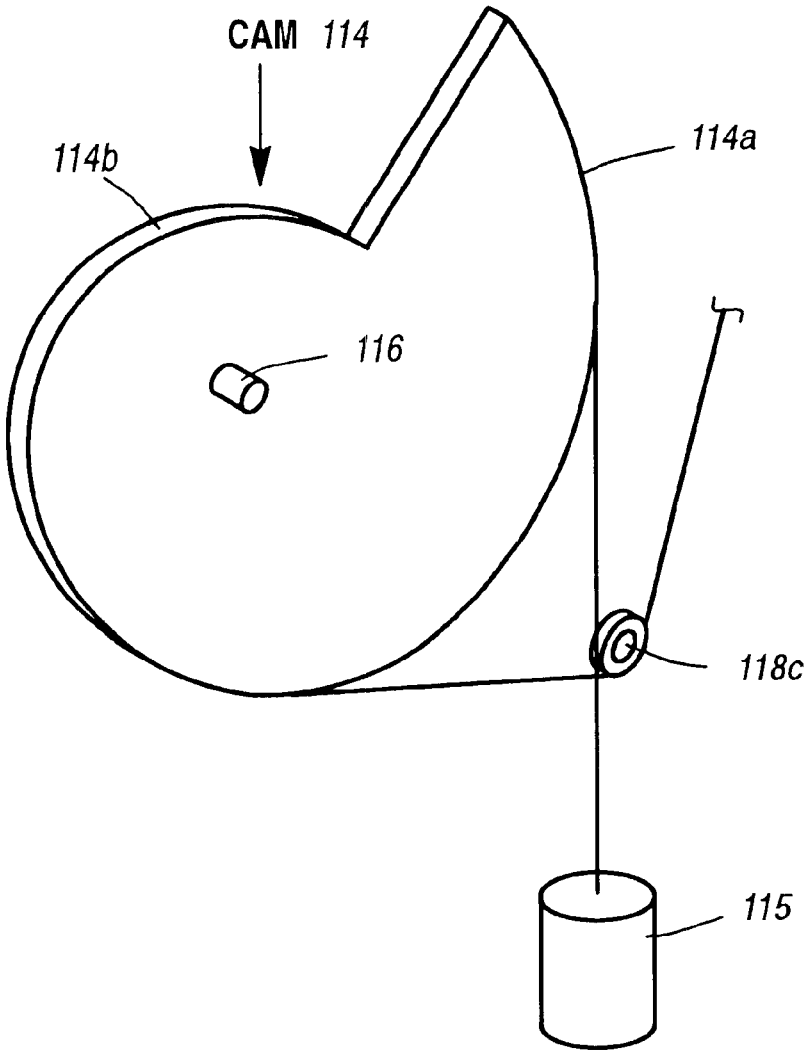
FIG. 2 is a perspective view of an alternative driving means for rotatably driving a cam of the arrangement of FIG. 1.

The drawing shows merely exemplary embodiments of the present invention for purposes of illustration only, one skilled in the art will readily recognize that the principles of the invention are well adapted for application to devices other than document handling devices as well as to document handling devices other than the one shown in the drawing. Furthermore, one skilled in the art will readily appreciate that various adaptations of the preferred embodiment may be combined or otherwise modified without departing from the scope of the invention.

A document handling apparatus 100 is illustrated in FIG. 1. As shown, the document handling apparatus 100 includes a hopper 104 which contains a document stack 106. The hopper 104 has a floor 104*a* and a leading edge guide wall 104*b* that serve to support the documents in the document stack 106. Leading edge guide wall 104*b* also provides support for a flag element 102. Flag element 102 abuts the document stack 106 and, during feeding, is used to move the document stack 106 across the hopper floor 104*a* toward feeding elements 108. Feeding elements 108 include mechanisms commonly known in the art, such as a nip, nudger, and feed wheel. Documents are then individually removed from the hopper 104 by feeding elements 108 and are introduced into a document transport (not shown) for processing and sorting.

The flag element 102 is associated with a cam 114 by a flag drive string 110, as seen in the preferred embodiment of FIG. 1, or by some other suitable flexible connector, such as a cable or chain. The flag drive string attaches to the flag element 102 and is guided by pulley 118*a* and pulley 118*b*, which are attached along the leading edge guide wall 104*b*. An additional pulley 118*c* guides the flag drive string 110 to its attachment at cam 116. FIG. 1 shows a preferred embodiment in which the flag drive string 110 attaches to a constant weight 112. Alternatively, the constant weight 112 may be excluded from the system.

The cam 114 is shaped such that its radius varies. As depicted in FIG. 1, cam 114 has a minimum radial distance 114*b* and gradually increases to a maximum radial distance 114*a*. The cam 114 is rotatively supported by shaft 116. In the preferred embodiment of FIG. 1, the shaft 116 connected to an electric motor 120 is shown as a method of producing a torque on the cam. Alternatively, other known force generating mechanisms may be used to create a torque on the cam 114, such as a dead weight 115 suspended from a cable.

During operation, electric motor 120 produces a constant torque. Shaft 116 acts to transfer the torque developed by the electric motor 120 to the cam 114, causing it to rotate. The rotation of the cam 114 exerts a tension on the flag drive string 110 and subsequently on the flag element 102. Accordingly, the flag element 102 then exerts a force at the back end of the document stack 106. The flag drive string 110 prevents free motor rotation.

The cam 114 takes advantage of the known relationship between the flag element 102 position and the flag drive string 110 position. The cam 114 is shaped such that the force of the flag element 102 produced by a constant motor torque varies to suit the size of the document stack 106 in the hopper 104. For example, if the document stack is large, a large flag force is required; since the motor torque is constant, the radial length of the cam is small. As the size of the document stack decreases, the force required to move the document stack decreases; since the motor torque is constant, the radial length of the cam must increase.

As stated above, in the preferred embodiment of FIG. 1, a constant weight 112 is interconnected between the flag element 102 and the cam 114. The constant weight 112 is supplemental to the motor 120 to reduce the requirement on the motor 120, thereby reducing wear and increasing its service life. In addition, should the motor 120 fail, the constant weight 112 could allow the document handling device 100 to continue to function at a reduced performance level.

The arrangement of the present invention allows the cam to take advantage of the known relationship between the flag element position and the flag drive string position in order to match the flag element force needed to move the document stack. Because the arrangement is capable of adjusting flag force requirements without the use of sensors, it is economical to produce and minimizes system complexity issues.

In addition, if an electric motor is used with the cam, additional adjustments can be made to increase the performance of the document handling device. For example, the current supplied to the motor could be altered to accommodate document handling devices of different speeds. Since document handling devices use a variety of speed selections to perform simple, high volume document processing or complex, low volume document processing, the electric current could be adjusted to match the speed requirement of the particular document processing operation. In addition, since the feeding elements of document handling devices are subject to wear, the motor could be adjusted to work in harmony with the performance of the worn feeding elements.

A variation of the present invention would be to include sensors with the present invention to further optimize the performance of the document handling device.

The foregoing discussion and drawing discloses and describes merely an exemplary embodiment of the present invention. One skilled in the art will readily recognize from such discussion that various changes, modifications and variations may be made therein without departing from the scope of the invention as defined in the following claims.

What is claimed is:

1. An arrangement for adaptively driving a document stack in a document handling device comprising:

a hopper for supporting the document stack;

a flag element supported by said hopper for applying a force to the document stack; and, a cam connected with said flag element such that rotation of said cam exerts a force on said flag element, wherein said cam is shaped such that the force exerted on said flag element varies in accordance with the size of the document stack in the hopper of the document handling device, and wherein said rotation of said cam is caused by a torque-producing electric motor.

2. The arrangement of claim 1 wherein the flag element and the cam are interconnected by a flexible connector.

3. The arrangement of claim 2 wherein the flexible connector is a flag drive string.

4. The arrangement of claim 2 wherein the flexible connector is a cable.

5. The arrangement of claim 2 wherein the flexible connector is a chain.

6. The arrangement of claim 1 wherein a constant weight for providing a supplemental force on said flag element is interconnected between said flag element and said cam.

7. The arrangement of claim 1, wherein said radius of said cam increases from a minimum inner radial distance to a maximum outer radial distance.

8. An arrangement for adaptively driving a flag element against a document stack of a document handling device comprising:

a cam connected with the flag element such that the rotation of said cam exerts a force on the flag element, wherein said cam is shaped such that the force exerted on the flag element varies in accordance with the size of the document stack of the document handling device; and an electric motor for rotating said cam.

9. The arrangement of claim 8 wherein the flag element and the cam are interconnected by a flexible connector.

10. The arrangement of claim 9 wherein the flexible connector is a flag drive string.

11. The arrangement of claim 9 wherein the flexible connector is a cable.

12. The arrangement of claim 9 wherein the flexible connector is a chain.

13. The arrangement of claim 8, wherein said radius of said cam increases from a minimum inner radial distance to a maximum outer radial distance.

14. An arrangement for adaptively driving a document stack in a document handling device comprising:

a hopper for supporting the document stack;

a flag element supported by said hopper for applying a force to the document stack;

a cam connected with said flag element such that the rotation of said cam exerts a force on said flag element, said cam is shaped such that the force exerted on said flag element varies in accordance with the size of the document stack in the hopper of the document handling device; and a constant weight for providing a supplemental force on said flag element interconnected between said flag element and said cam.

15. The arrangement of claim 14, wherein said cam has a variable radius that increases from a minimum inner radial distance to a maximum outer radial distance.

16. An arrangement for adaptively driving a flag element against a document stack of a document handling device comprising:

a cam connected with the flag element such that the rotation of said cam exerts a force on the flag element, wherein said cam is shaped such that the force exerted on the flag element varies in accordance with the size of the document stack of the document handling device; and a constant weight for providing a supplemental force on said flag element interconnected between said flag element and said cam.

17. The method of adaptively driving a flag element of a document-handling device against a document stack including the steps of:

connecting a cam with the flag element;

driving said cam with an electric motor, such that the rotation of said cam exerts a force on the flag element, wherein said cam is shaped such that the force exerted on the flag element varies in accordance with the size of the document stack of the document handling device.

* * * * *